US005316375A

United States Patent [19]

Breen

[11] Patent Number: 5,316,375

[45] Date of Patent: May 31, 1994

[54] BACK SUPPORT AND INTERNAL FRAME

[75] Inventor: William R. Breen, Etobicoke, Canada

[73] Assignee: Buddy Orthopoedic Inc., Etobicoke, Canada

[21] Appl. No.: 914,090

[22] Filed: Jul. 16, 1992

[51] Int. Cl.[5] ..... A47C 7/28

[52] U.S. Cl. ..... 297/452.34; 297/452.53; 297/284.9

[58] Field of Search ..... 297/460, 284.9, 284.4, 297/284.1, 452, 452.34, 452.33, 452.29, 452.18, 452.1, 452.49, 452.52, 452.53

[56] References Cited

U.S. PATENT DOCUMENTS

| | | | |
|---|---|---|---|
| 2,059,597 | 11/1936 | Okano . | |
| 2,769,485 | 11/1956 | Shapiro . | |
| 2,843,195 | 7/1958 | Barvaeus . | |
| 3,189,381 | 6/1965 | Heidt et al. | 297/230 |
| 3,197,255 | 7/1965 | Caudill | 297/460 |
| 3,639,002 | 2/1972 | Tischler | 297/452 |
| 3,669,498 | 6/1972 | Meyers et al. | 297/460 X |
| 3,697,133 | 10/1972 | Wolofski | 297/460 |
| 3,856,349 | 12/1974 | Light | 297/230 |
| 3,860,287 | 1/1975 | Platt | 297/452 |
| 4,191,424 | 3/1980 | Mundell | 297/452 X |
| 4,296,965 | 10/1981 | Sakurada et al. | 297/284.4 |
| 4,418,958 | 12/1983 | Watkin | 297/457 |
| 4,595,180 | 6/1986 | Hagemeister | 5/255 X |
| 4,636,006 | 1/1987 | Kazaoka et al. | 297/452 X |
| 4,938,529 | 7/1990 | Fourrey | 297/284.9 |
| 5,022,709 | 6/1991 | Marchino | 297/460 X |

*Primary Examiner*—Kenneth J. Dorner
*Assistant Examiner*—Milton Nelson, Jr.
*Attorney, Agent, or Firm*—Bereskin & Parr

[57] ABSTRACT

There is provided a frame for use with a back support that provides lateral support to an individual while seated to encourage a correct sitting posture, and that also provides lumbar support to the individual that varies according to the individual's size. The frame includes wing portions that act as lateral supports and as torsion bars to cause the center portion of the frame to become convex to support the lumbar region of an individual resting against the back support incorporating the frame. The frame can be incorporated into a portable support unit or to a support unit that is an integral part of a chair.

11 Claims, 4 Drawing Sheets

BACK SUPPORT AND INTERNAL FRAME

FIELD OF THE INVENTION

The present invention relates to the field of back support units and provides, in particular, a support unit incorporating a frame that encourages a correct sitting posture and automatically adjusts to support a person's lower back.

BACKGROUND OF THE INVENTION

Stiffness and soreness, especially in the lower back area, are common ailments of individuals who spend a great deal of time sitting down. Usually, these ailments are due to a combination of poorly designed seating and a poor posture while seated.

A correct sitting posture requires that individuals be seated with their backs straight and their weight evenly balanced on their buttocks and thighs. Unfortunately, through bad habits or a lack of muscle strength, many individuals tend to lean on an armrest or slouch down in their seats. Also the tasks people often conduct while seated require them to regularly lean forward, or to one side, to operate a keyboard, reach a telephone, or operate a vehicle.

It is desirable that a chair or portable support be provided that encourages people to adopt a correct sitting posture while allowing them the freedom to move one way or another.

Along with encouraging people to develop a correct sitting posture, the seating should support the curvature of the spine to reduce the back strain occasioned by sitting for extended periods of time. The main area where people require support is in the lower back at the lumbar region of the spine. Stiffness and soreness in the lumbar region is usually a result of the lumbar curve of the spine having to support a majority of the weight of the upper body. The larger the individual, the greater the weight the curve must support. What is required is a device that adjusts itself to support the lumbar curve of the spine according to the upper body size of the user. The support should be rigid and should not affect the ability of the device to encourage a correct seating posture.

Many forms of back support units have been developed over the years. Examples of such units may be seen in U.S. Pat. No. 2,769,485 (Shapiro) and U.S. Pat. No. 3,697,133 (Wolofski).

Typically, such units are made from a foam material that is molded to mimic the curvature of the average person's spine. Sometimes an S-shaped internal frame is also provided to mimic the spine. This frame is usually made from a plastic or fibreglass material. The curvature of the spine varies greatly with the population however and the molded or shaped units are rarely able to provide support where it is needed. The support that is provided is often not rigid enough to support the upper body weight acting upon the spine. Also, molded foam material and plastic or fibreglass frames tend to break down and lose their curvature over time to even further reduce the support provided.

The present invention overcomes these problems by providing a support unit that incorporates a frame providing lateral support to encourage a user to adopt a correct sitting posture and rigid lumbar support that automatically adjusts to a user's body size to support the lumbar region of their back.

SUMMARY OF THE INVENTION

In one aspect of the invention there is provided a frame for a back support unit, said frame comprising:

(a) a center portion extending transversely and in a longitudinal direction, (b) a pair of wing portions, said wing portions extending transversely and forwardly in opposite directions one from each side of said center portion, (c) said center portion comprising a plurality of column supports spaced apart transversely and extending in said longitudinal direction, (d) said center portion further including a plurality of cross members extending transversely and connected to said column supports, (e) at least one of said cross members having a pair of wing sections extending transversely into said wing portions, for said wing sections to be depressed rearwardly when a person sits against said backrest and for the rearward movement of said wing sections to cause said center portion to bulge forwardly at least adjacent said one cross member and hence to assume a convex shape, such convexity providing lumbar support to said person.

DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

DESCRIPTION OF THE PREFERRED EMBODIMENT

Figure 1:
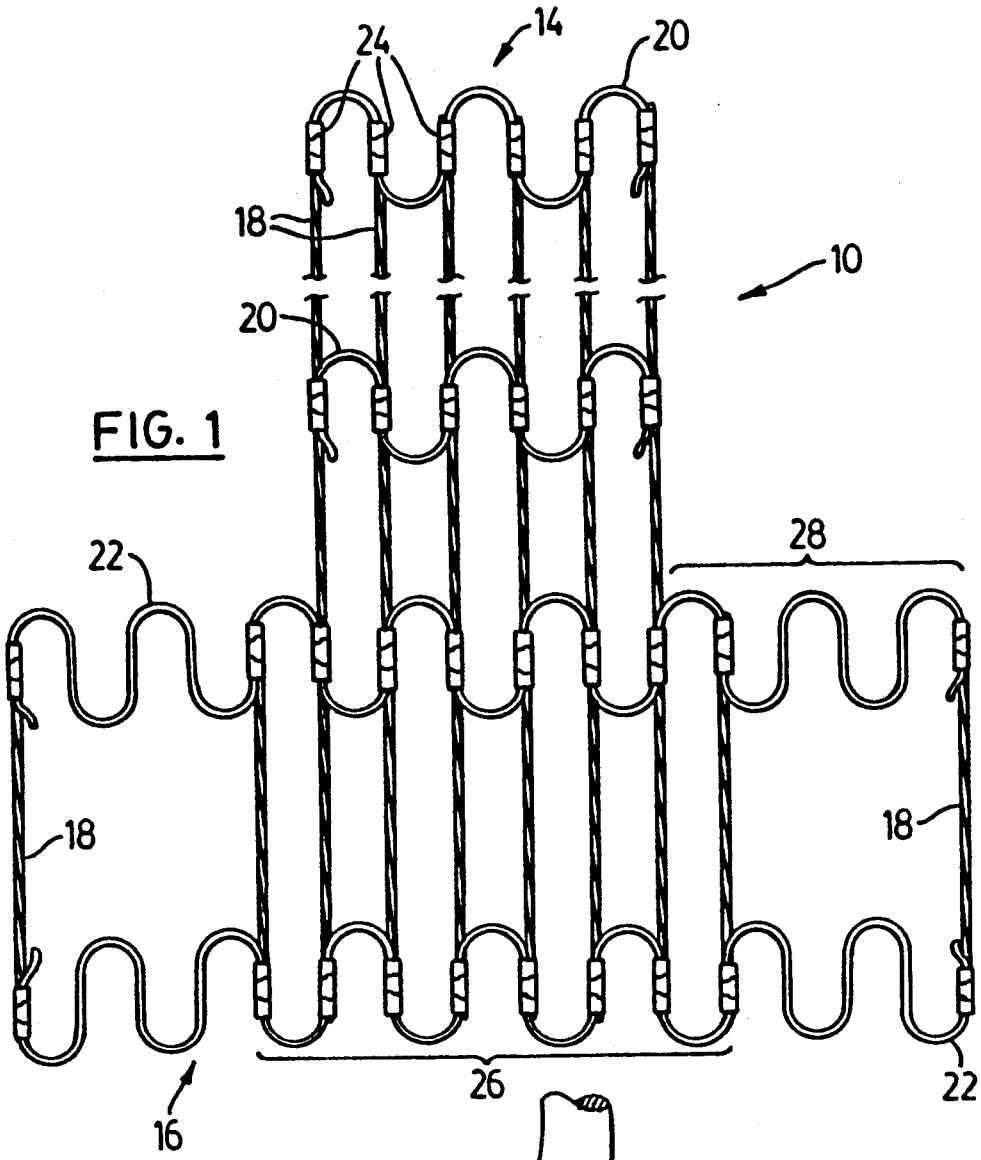
FIG. 1 is a front view of a frame for a back support unit in accordance with the present invention.
Figure 6:
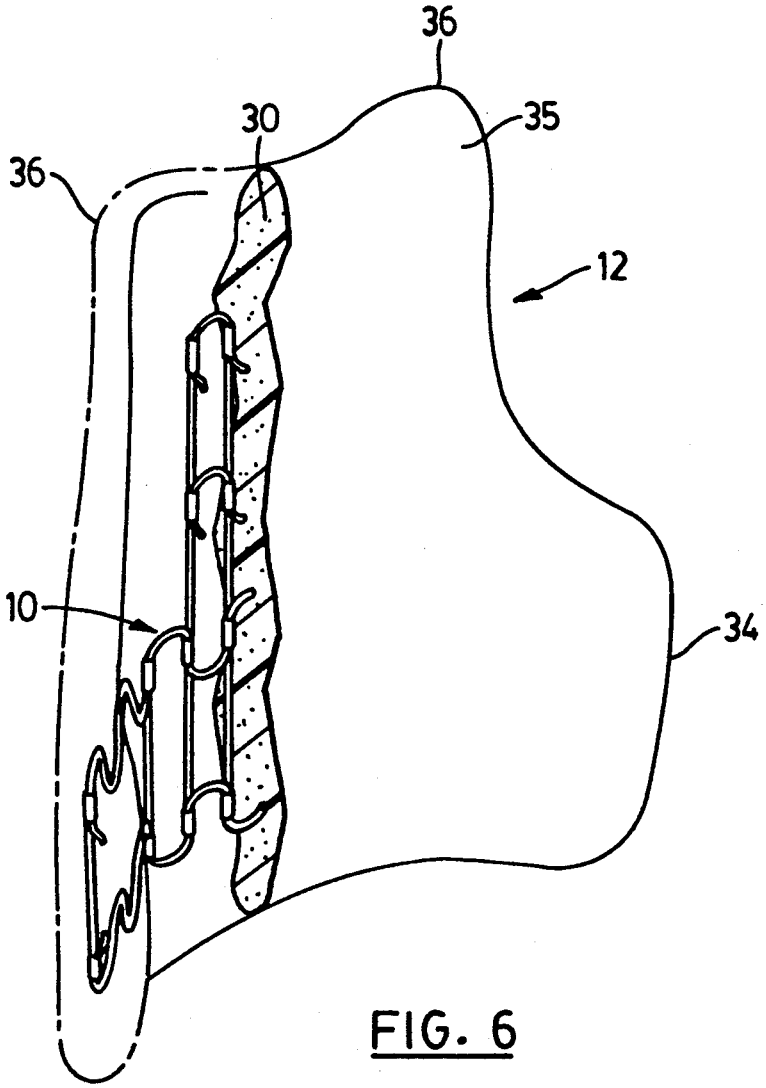
FIG. 6 is a perspective partial sectional view of a portable back support unit showing the frame molded into a padded body.

Referring first to FIGS. 1 and 6, there is shown a frame 10 for a back support 12. The frame 10 has a center portion 14 and a pair of wing portions 16.

The center portion 14 has a greater height than the wing portions 16 as may be seen in FIG. 1. It is conceivable however that both portions may have the same height to provide a frame 10 that is either low, for a back support 12 for the lower back only, or high, for a full height of lateral support.

Figure 3:
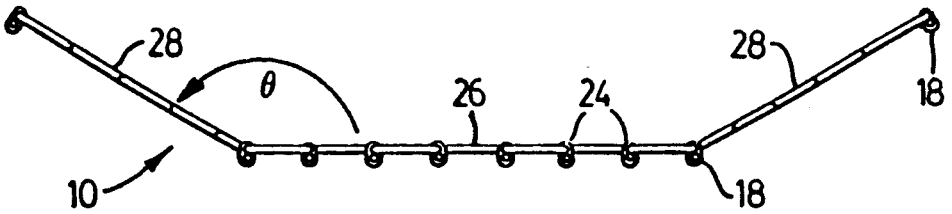
FIG. 3 is a bottom view of one embodiment of the frame shown in FIG. 1 where the center portion is generally planar when not in use.
Figure 5:
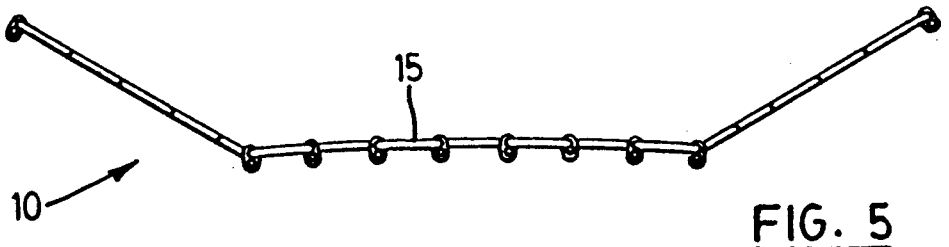
FIG. 5 is a bottom view of another embodiment of the frame shown in FIG. 1 where the center portion has a slight forward bow while not in use.

The center portion 14 is generally planar as shown in FIGS. 1 and 3. Alternatively, the center portion 14 may have a slight convexity as shown at 15 in FIG. 5. The convexity provides an initial minimum lumbar support as will be described further below.

The wing portions 16 are each generally planar and extend forwardly at an obtuse angle from the elongate sides of the center portion 14. They are provided to give lateral support to the support unit 12 and to exert a torsional force upon the center portion when the unit is occupied.

The frame 10 is made up of parallel spaced-apart column supports 18 that extend in a longitudinal direction. This direction (generally vertical) corresponds generally with the orientation of an individual's spinal column, so that the device may mimic its support of the individual's upper body weight.

The frame 10 also includes upper and lower cross members 20 and 22 that extend in a transverse direction. This direction corresponds generally with the breadth of an individual's thoracic and lumbar regions, so that the device may mimic the support provided by muscles in these regions.

Figure 2:
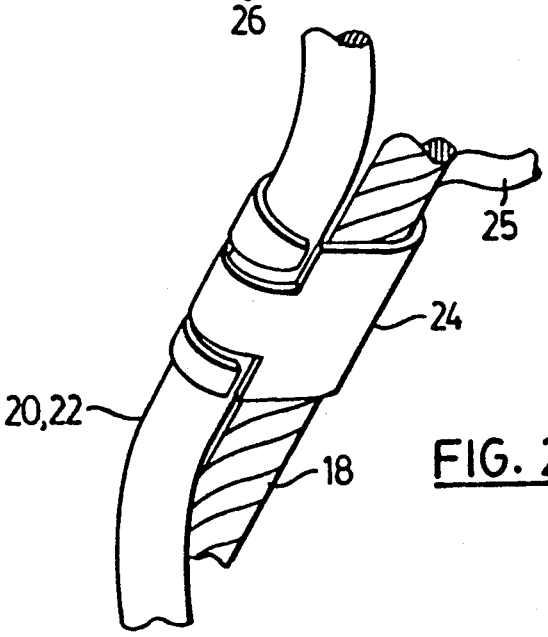
FIG. 2 is an enlarged view of a clip connecting a column support to a cross member.

The column supports 18 are connected by connectors 24 to the cross members. A range of connectors 24 can be used, but metal clips 24 as shown in FIG. 2 are preferred. These clips 24 are crimped about intersections between the column supports 18 and the cross members. The column supports 18 are preferably wrapped in paper 25 before being clipped to the cross members to further tighten the connection and prevent relative movement between the respective members.

The upper cross members 20 are generally planar and span the upper end of the center portion 14 of the frame 10. They are resilient both forwardly and rearwardly in relation to the general plane of the center portion 14.

The lower cross members 22 are bent and have a center section 26 and two wing sections 28. The wing sections 28 extend at an obtuse angle $\theta$ (FIG. 3) from the ends of the center section 26. An angle $\theta$ of 135° is preferred. The lower cross members 22 are also resilient forwardly and rearwardly in relation to the general plane of the center portion 14. The wing sections 28 thus cause the frame 10 to be of generally concave appearance as viewed from its front.

Preferably, the wing sections 28 are integral with their corresponding center section 26, although it is conceivable that they may be distinct and immovably attached to the center section 26. Alternatively, it is conceivable that there may be a ratchet attachment (not shown) between the wing sections 28 and their corresponding center section 26. A ratchet attachment would provide fixed resistance when the wing sections 28 are depressed rearwardly in relation to the general plane of the center portion 14. It is conceivable that such ratchet attachments could be releasably locked to vary the obtuse angle between the wing sections 28 and the center section 26. This would allow the wing portions 16 of the frame 10 to be adjusted to provide a more precise lateral support conforming to each individual's needs.

Figure 4:
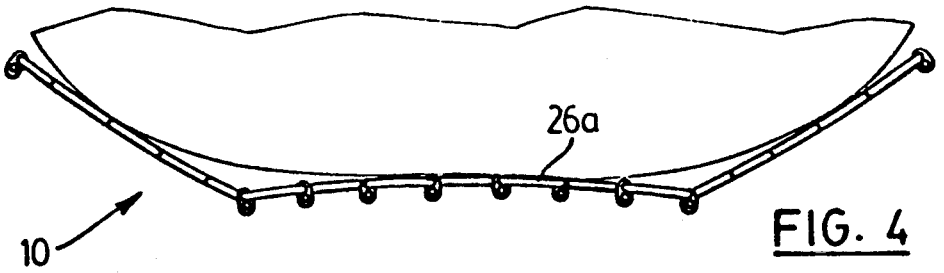
FIG. 4 is a bottom view of the frame shown in FIG. 3 with the wing portions being pressed rearwardly to cause the center portion to bow forwardly.

The wing sections 28 of the lower cross members 22 act as torsion bars upon their corresponding center section 26 when a person rests against the back support 12. The torsional forces cause the center section 26 to become convex forwardly (as shown at 26a in FIG. 4) in relation to the plane of the center portion 14 when the wing sections 28 are depressed rearwardly. The wing sections 28 would be depressed when an individual rests against a back support 12 incorporating the frame 10.

The column supports 18 extending along the center portion 14 are closely spaced and preferably parallel. They act to transfer the convexity imparted upon the center section 26 along a portion of the longitudinal extent of the center portion 14. The plane of the center portion 14 thus acquires a convexity in a transverse direction adjacent the wing portions 16. This convexity is transferred through the back support 12 to engage the lumbar region of an individual's lower back, when the individual is resting against the support unit 12.

Figure 4A:
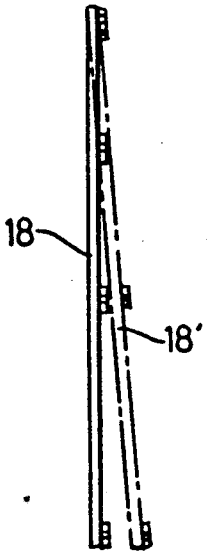
FIG. 4A is a side view showing movement of a support column forwardly when the wing portions are pressed rearwardly.

While the center sections 26 of the lower cross members 22 have a convexity formed in them when a user leans against the back support, the upper cross members 20 remain largely planar. This causes the central column supports 18 to move from a generally vertical position to the forwardly slanted position shown in phantom lines at 18' in FIG. 4A. However, the column supports 18 remain generally straight during this movement.

While it is preferred that the column supports are straight, it is conceivable that they could have a curve imparted along their length. This curve could mimic the curvature of the spine, if desired.

The column supports 18 extending along each of the wing portions 16 are preferably parallel and spaced further apart than the column supports 18 extending along the center portion 14. This ensures that the wing portions 16 are not too rigid and thus optimizes their function as torsion bars.

The cross members 22 are preferably formed from tempered wire. This wire has a long lasting resiliency and an enhanced "memory". It has been found that plastic or wooden frames loose their resiliency over time and thus provide reduced lumbar support. The cross members shown in FIG. 1 have a lateral, continuous S-shaped configuration that is well suited for translating the torsional forces that are placed upon the wing sections 28.

The column supports 18 may thus be attached by the clips 24 at the points where the lateral S-shaped cross member is parallel to the column support. The center portion 14 of the frame 10 shown in FIG. 1 is thus formed with six column supports 18 along its center portion 14 and two column supports 18 along each of its wing portions 16.

The wing portions 16 of the frame 10 preferably have a height of approximately 18–19 centimeters. For such a height, two lower cross members 22 are preferred to provide optimum lateral and lumbar support. The height of the center portion 14 may be varied to provide frames for high and low backed supports 12. For a low back support the center portion 14 preferably has a height of approximately 40 centimeters. For such a height, two upper cross members 20 are sufficient. A frame 10 for a high back support 12 would have three upper cross members 20 and a height of approximately 53 centimeters.

Figure 7:
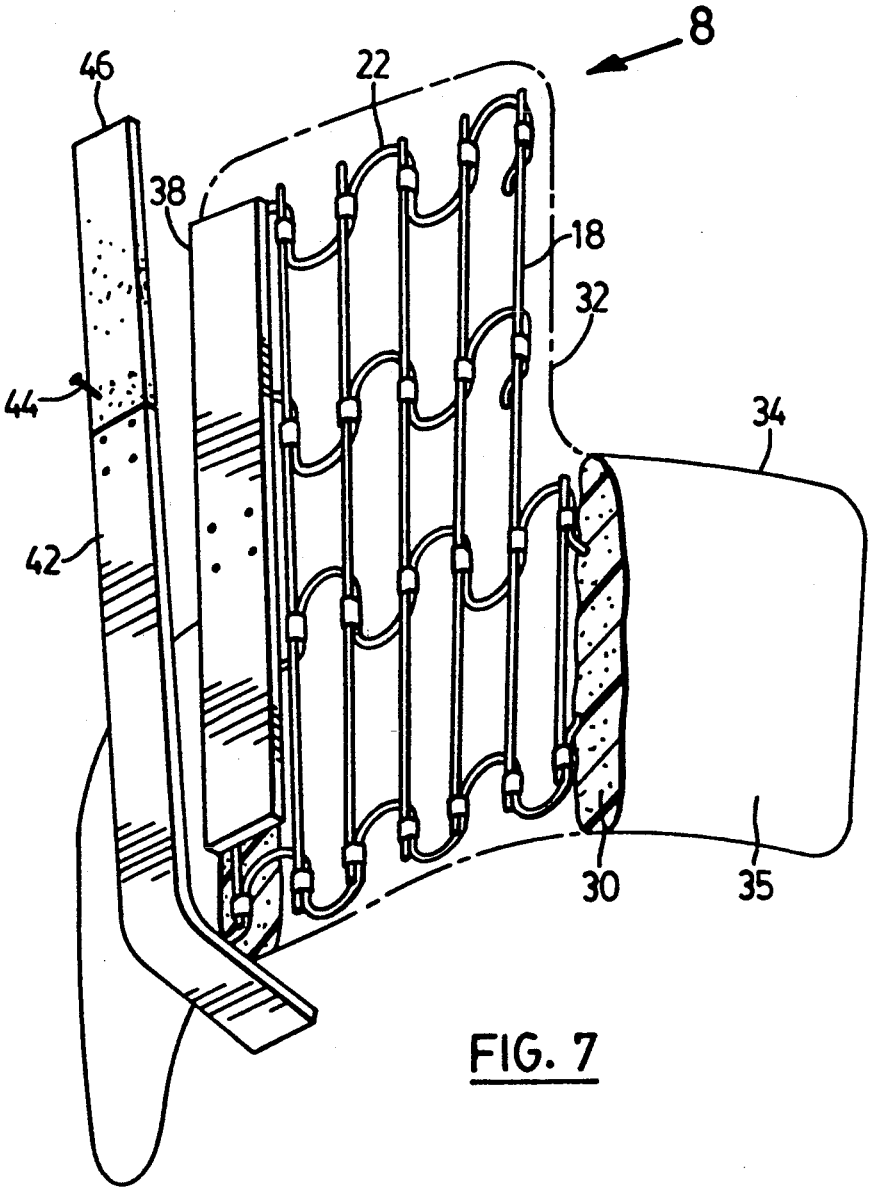
FIG. 7 is an exploded perspective partial sectional view of an integral back support unit showing a back post being secured to a backboard.

The frame 10 is molded into the back support unit 12 by encasing it with a padding 30 and a cover 32 as may be seen in FIGS. 6 and 7. The padding 30 is preferably made from a high density foam that is firm and long lasting. A range of cover materials may be made from any appropriate cloth or other material. The frame 10 is oriented within the support unit so that the lower part of the center portion 14 will correspond with the lumbar region of an individual's back while sitting against the unit.

The back support unit shown in FIG. 6 is a portable unit while the back support unit shown in FIG. 7 is for an integral unit that forms the back of a chair.

As may be seen in FIGS. 6 and 7, the back support unit has an upper back portion 32 and two side portions 34. The side portions 34 are generally translations of the wing portions 16 of the frame 10, although they may be molded to form a gradual arc from the upper back portion 32 as depicted in FIG. 6. This provides a comfortable lateral side support for the back unit that does not overly restrict sideward motion such as may occur when driving a car or reaching, to one side of a chair.

The cover 35 is preferably glued to the foam padding 30. The upper back portion 32 of the back support unit 12 has ears 36 as shown in FIG. 6 that allow the cover 35 to be centered before being drawn over the padding 30 containing the glue. Otherwise, the cover 35 would be difficult to install because of the tendency of the glue to dry quickly.

Figure 8:
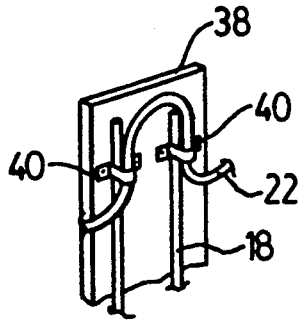
FIG. 8 is an enlarged front view of an upper part of the center portion of the frame secured by clips to the backboard.

The integral back unit depicted in FIG. 7 includes a backboard 38 that is attached to the frame 10 by fasteners 40 at the upper end of the center portion 14 as may be seen in FIG. 8. The backboard 38 is then molded into the padding 30 of the back support unit and thus hidden from view. The lower portion of the backboard 38 is not fastened to the frame 10 and thus the center portion 14 of the frame 10 is free to become convex when the wing portions 16 are pressed. With the addition of the backboard 38, the back support 12 may be secured to a back post 42 of a chair. The back post 42 may be attached to backboard 38 through the back of the back support 12 using attachments 44 such as screws or T-nuts. A fabricated foam strip 46 may be provided to fill the space between the top of the back post 42 and the remaining upper back portion 32 of the back support 12.

It is understood that preferred embodiments of the invention have been described and that changes and alternative embodiments may be made within the spirit of the invention as defined by the appended claims.

I claim:

1. A frame for a back support, said back support being adapted to face forwardly towards a user's back, said frame comprising;

(a) an elongated center portion having a top and a bottom and a pair of sides and extending in a longitudinal direction between said top and bottom, said center portion also extending in a transverse direction between said sides, said transverse direction being at right angles to said longitudinal direction, said center portion being configured in one of a substantially flat orientation and a slightly convex forward orientation.

(b) a pair of wing portions, said wing portions extending oppositely in said transverse direction and forwardly, one wing portion extending from each side of said center portion, said wing portions having outer free ends, (c) said wing portions being of smaller dimension in said longitudinal direction than said center portion and being located adjacent said bottom of said center portion, there being no wing portions adjacent the top of said center portion, (d) said center portion comprising a plurality of parallel column supports spaced apart in said transverse direction and extending in said longitudinal direction, there being a pair of said column supports one adjacent each side of said center portion, and a plurality of column supports between said pair of column supports, (e) said center portion further including a plurality of cross members extending in said transverse direction and each connected rigidly to each of said column supports, (f) at least one of said cross members having a pair of wing sections extending transversely into said wing portions, said one cross member being located in a lumbar region of said user's back, for said wing sections to be depressed rearwardly when a user sits against said backrest and for the rearward movement of said wing sections to cause said center portion to bulge forwardly at least adjacent said one cross member and hence to assume a convex shape adjacent said lumbar region, and for said center portion to remain unbulged forwardly adjacent its top, so that the center part of said center portion will then assume an increasingly convex shape from said top of said center portion to said one cross member, such convexity providing lumbar support to said user.

2. A frame according to claim 1, including padding means molded about said frame, and a cover encasing said padding.

3. A frame according to claim 1 wherein said center portion has an upper portion adjacent said top and a lower portion adjacent said bottom, and including a padding molded about said frame, and a post connected to said upper portion of said center portion, said post being unconnected to said lower portion of said center portion thus to allow the lower portion of said center portion to bulge forwardly, said post being adapted to be connected to a chair.

4. A frame according to claim 1, wherein said column supports are closely spaced.

5. A frame according to claim 4, wherein two said cross members extend into said wing portions.

6. A frame according to claim 5, wherein at least said two cross members are formed of tempered wire.

7. A frame according to claim 6, wherein at least said two cross members have a continuous S-shaped configuration, said cross members thereby having portions extending in said longitudinal direction and portions extending in said transverse direction, said cross members being rigidly connected to said column supports at said portions extending in said longitudinal direction.

8. A frame according to claim 7, wherein said column supports and said cross members are connected together by crimped clips.

9. A frame according to claim 8 and including a paper wrapping around each column support to reduce the likelihood of slippage between said cross members and said column supports.

10. A frame according to claim 9, wherein there are at least two column supports extending longitudinally in each wing portion.

11. A frame according to claim 10, wherein there are at least two cross members above said first mentioned two cross members.

* * * * *